United States Patent [19]

Kanda et al.

[11] Patent Number: 4,782,001

[45] Date of Patent: Nov. 1, 1988

[54] PROCESS FOR PRODUCING TONER FOR DEVELOPING ELECTROSTATIC IMAGES AND APPARATUS THEREFOR

[75] Inventors: Hitoshi Kanda, Yokohama; Takeo Meguro, Toride, both of Japan

[73] Assignee: Canon Kabushiki Kaisha, Tokyo, Japan

[21] Appl. No.: 173,046

[22] Filed: Mar. 28, 1988

Related U.S. Application Data

[63] Continuation of Ser. No. 850,179, Apr. 10, 1986, abandoned.

[30] Foreign Application Priority Data

Apr. 18, 1985 [JP] Japan ..... 60-81266
Feb. 14, 1986 [JP] Japan ..... 61-31398

[51] Int. Cl.[4] ..... B02C 19/06; G03G 9/00

[52] U.S. Cl. ..... 430/137; 241/24; 241/81; 209/10; 209/135

[58] Field of Search ..... 430/137; 241/24, 81; 209/10, 135

[56] References Cited

U.S. PATENT DOCUMENTS 4,132,634 1/1979 Rumpf et al. ..... 209/136
4,304,360 12/1981 Luhr et al. ..... 241/79.1

OTHER PUBLICATIONS

Perry, Chemical Engineering Handbook, 1963.

*Primary Examiner*—J. David Welsh
*Attorney, Agent, or Firm*—Fitzpatrick, Cella, Harper & Scinto

[57] ABSTRACT

A process for producing toner particles for developing electrostatic latent images, comprising the steps of introducing colored solid particles containing a binder resin into a multi-division classifying zone divided into at least three sections by partitioning means, so that the particles are fallen along curved lines; collecting a coarse powder consisting primarily of coarse particles in a first divided section, a medium powder consisting primarily of particles having a particle size within a defined range in a second divided section and a fine powder consisting primarily of particles having a particle size smaller than the defined range in a third divided section; feeding the classified coarse powder to a pulverizing step; and introducing the pulverized powder into the multi-division classifying zone. An apparatus for practicing the process is also disclosed.

13 Claims, 4 Drawing Sheets

PROCESS FOR PRODUCING TONER FOR DEVELOPING ELECTROSTATIC IMAGES AND APPARATUS THEREFOR

This application is a continuation of application Ser. No. 850,179, filed Apr. 10, 1986, now abandoned.

FIELD OF THE INVENTION AND RELATED ART

The present invention relates to a process and an apparatus for producing a toner having a predetermined particle size for developing electrostatic images, by effectively pulverizing and classifying solid particles containing a binder resin.

In image forming processes such as electrophotography, electrostatic photography and electrostatic printing, a toner is used to develop an electrostatic image.

For a process for producing a final product by pulverizing and classifying starting solid particles in the production of a toner for developing an electrostatic image in which the final product is required to be of very fine particles, in general, a process as shown in a flow chart in FIG. 7 is conventionally adopted. This process involves melt kneading starting materials such as a binder resin and coloring agent (e.g., dye, pigment or magnetic material), cooling the kneaded mixture for solidification followed by pulverization, thereby giving a group of pulverized solid particles as a pulverized product from the starting materials. The pulverized product is continuously or successively fed into first classifying means and classified therein, and the coarse powder consisting primarily of a group of the classified particles having a particle size greater than a defined range of sizes is fed into pulverizing means and pulverized therein, and then recycled to the first classifying means. The powder consisting primarily of other particles having particle sizes respectively falling within and smaller than the defined range is passed into second classifying means and classified into a medium powder consisting primarily of a group of particles having a particle size within the defined range and a fine powder consisting primarily of a group of particles having a particle size smaller than the defined range.

For example, to provide a group of particles having a weight average particle size of 10 to 15 microns and containing 1% or less of particles having a particle size smaller than 5 microns, a feed material is pulverized for classification in pulverizing means, such as an impact-type or jet-type pulverizer provided with a classifying mechanism for removing a coarse powder until a predetermined average particle size is achieved, and the pulverized product free of the coarse powder removed is passed to another classifier to remove fine powder, thus giving a desired medium powder.

The weight average particle size used herein is an expression of the results of measurements, for example, by a Coulter counter available from Coulter Electronics, Inc. (U.S.A.). The weight average particle size will be sometimes simply referred to as an "average particle size" hereinafter.

Such conventional processes are accompanied by the following problems. Because the treatment by the pulverizer provided with the classifying mechanism for removing the coarse powder and the treatment by the classifier for removing the fine powder are conducted in separate steps, the number of steps increases, and the operation is complicated, and for a long run, heat generation may occur, or significant unavoidabe deposition and aggregate may be produced in the powder in some cases.

The purpose of the classifying means for the removal of coarse powder is to pass only the particles having a particle size greater than a certain particle size into the pulverizer. With the conventional classifier, because of a very long residence time for the powder as long as several minutes, a part of the particles may interaggregate after the removal of the coarse powder, or fine particles may deposit onto coarse particles, and the resultant particles are again returned to the pulverizer, resulting in a tendency of overpulverization. This causes a reduction in pulverizing efficiency and in yield in the classifier for removing fine powder in the subsequent step. In the second classifying means for removing fine powder, the aggregate constituted of extremely fine particles may be produced in some cases and are difficult to remove as fine powder. In such a case, the aggregate may be incorporated in a final product, resulting in a difficulty to produce a product having an exquisite distribution of particle sizes, while the aggregate may be broken in the resultant toner to form extremely fine particles, causing a degradation in quality of image. In the conventional processes, even if a desired product having an exquisite distribution of particle size could be obtained, unavoidable disadvantages are encountered such as complication of procedure, reduction in classifying yield and in efficiency of production, and increase in cost. The smaller the predetermined particle size, the more such tendency will be remarkable.

SUMMARY OF THE INVENTION

It is an object of the present invention to provide a process for producing a toner for developing electrostatic images, wherein the above mentioned various problems found in the prior art processes are overcome.

It is another object of the present invention to provide a process for effectively producing an electrostatic image-developing toner having an accurate distribution of particle sizes.

It is further object of the present invention to provide a process for effectively producing an electrostatic image-developing toner having a good quality and smaller particle size (e.g., of 2 to 8 microns).

It is a yet further object of the present invention to provide a process for effectively producing a product of fine particles (for use as a toner) having an accurate distribution of particle sizes with a good yield from solid particles produced by melt kneading a mixture comprising a binder resin, a coloring agent and various additives, cooling the kneaded mixture, and then pulverizing it.

A still further object of the present invention is to provide a process for producing toner particles for developing electrostatic latent images, comprising the steps of introducing a group of colored solid particles containing a binder resin into a multidivision classifying zone divided into at least three sections by partitioning means, so that the particles are fallen along curved lines; collecting a coarse powder consisting prmarily of coarse particles in a first divided section, a medium powder consisting primarily of particles having a particle size within a defined range in a second divided section and a fine powder consisting primarily of particles having a particle size smaller than the defined range in a third divided section; feeding the classified coarse powder to a pulverizing step; and introducing the pulverized powder into the multi-division classifying zone.

According to the present invention, there is further provided an apparatus for producing a toner for developing electrostatic latent images, comprising: multi-division classifying means having at least three divisional sections for classifying colored solid particles containing a binder resin into fractions of particles including a coarse powder; means for pulverizing the coarse powder obtained from the multidivision classifying means; and communicating means for recycling the pulverized product of the coarse powder into the multi-division classifying means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
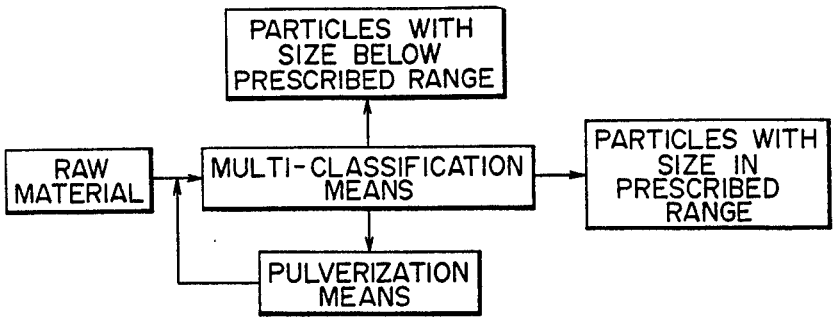
FIG. 1 is a flow chart of a process according to the present invention.

A process according to the present invention uses a pulverized material as a feed or raw material, and FIG. 1 is a flow chart illustrating the sequences of the process. The process of the present invention comprises feeding the feed material into a multi-division classifying zone to classify it into at least three particle size fractions: a larger particle size fraction (coarse powder consisting primarily of coarse particles), a medium particle size fraction (medium powder consisting primarily of particles having a particle size falling within a defined range) and a smaller particle size fraction (fine powder consisting primarily of particles having a particle size smaller than the defined range); pulverizing particles of the larger particle size fraction by proper pulverizing means and recycling the pulverized particles together with the newly introduced feed material into the multi-division classifying zone to subject them to the similar classification. The particles of medium particle size fraction having a particle size within the defined range and the particles of the smaller particle size fraction having a particle size smaller than the defined range, are withdrawn from the multi-division classifying zone by proper take-off means, respectively. The particles of the medium particle size fraction has a suitable distribution of particle sizes and ca be used as a toner as they are. On the other hand, the particles of the smaller particle size fraction may be reutilized by recycling them to a melting step. It is preferred that the true specific gravity of the powder to be classified is about 0.5–2, particularly 0.6–1.7.

Figure 2:
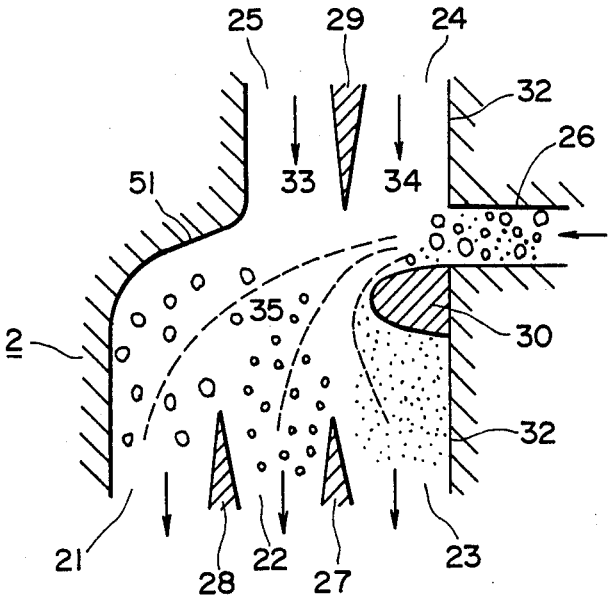
FIGS. 2, 3 and 4 are respectively a partial sectional view of a device as an embodiment in which solid particle multi-division classifying means in the present invention is brought into operation.
Figure 3:
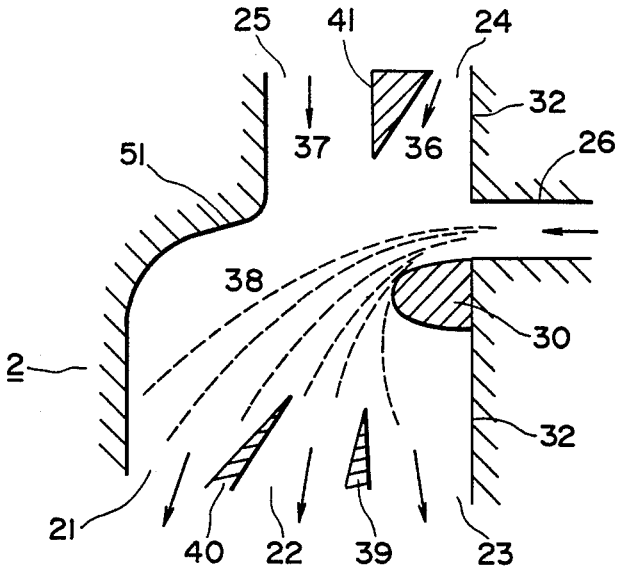
Figure 4:
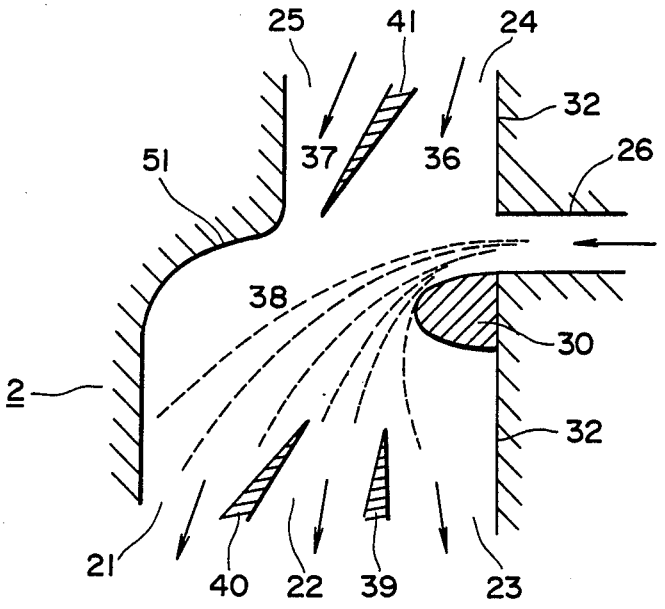

Means for providing the multi-division classifying zone include an apparatus and means as described in U.S. Pat. No. 4,132,634, and one specific embodiment is a multi-division classifier of a type shown in FIGS. 2, 3 and 4. In these Figures, the side walls are of shapes in section indicated by the reference numerals 32 and 51, and the bottom thereof is substantially rectangular and divided into three sections by classifying fences such as knife edge-shaped classifying wedges, 27 (or 39) and 28 (or 40) which are longitudinallysecured to or fitted at their bottoms in the bottom of the classifier in parallel at predetermined spaced distances. A feed material supply nozzle 26 opened into a classifying chamber is provided in that portion of a vertical wall 32 which is opposed to the substantially upright extending start point from a curved wall 51. A Coanda block 30 is projectedly mounted on the vertical side wall 32 and is shaped in an elliptic arc formed by folding downwardly with respect to the extension of the tangential line at the bottom of the nozzle. The upper portion of the classifying chamber is of upright square cylindrical configuration. An air intake wedge 29 (or 41) of a longitudinal knife edge shape is provided at the central portion of a top wall, and further, air intake conduits 24 and 25 opened into the classifying chamber are provided on the top wall. The locations of the classifying wedges 27 (or 39) and 28 (or 40) depend on the scale of the chamber of the multi-division classifying zone and vary depending on the type of feed material to be treated. On the bottom surface of the chamber, there are discharge conduits 21, 22 and 23 opened into the chamber, corresponding to the divided sections, respectively. The discharge conduits 21, 22 and 23 may be provided with opening and closing means such as valve means, respectively.

The classifying edges 27 (or 39) and 28 (or 40) are disposed with their edge portions faced upwardly to protrude into the space within the chamber. The intake wedge 29 (or 40) is normally disposed with the edge portion faced downwardly to extend from the top wall into the space within the chamber. When the group of particles of medium particle size fraction is intended to be classified into particles having a limited range of particle sizes, the classifying wedge 28 and the intake wedge 29 may be inclined at the rising portion of the former and at the descending portion of the latter as shown by the reference numerals 40 and 41 in FIG. 4 without changing the fixing position, respectively. The supplying of the feed material into the classifying chamber throgh the feed material supply nozzle 26 is conducted following a calibration curve depending on the type of the feed material.

The operation of classifying a feed material in the multi-division classifying zone constituted in the above manner is conducted, for example, in the following manner. A pulverized feed material is supplied through the feed material supply nozzle 26, so that the powder moves drawing a curved line 35 or 38 under the influence of the Coanda block 30 and under the action of a gas such as air entering with the feed material supplied and is thus classified by the particle sizes and the weights of the particles. If the particles have an equal specific gravity, the larger particles (coarse) are directed outside the gas stream, i.e., to a divided first section on the left side of the classifying wedge 28, the medium particles (having a particle size within the defined range) is to a divided second section between the classifying wedges 28 and 27, and the smaller particles (having a particle size less than the defined range) is to a third section on the right side of the classifying wedge 27, thus achieving the classification of the particles. The classified larger particles are discharged through a discharge port 21, the medium particles are discharged through port 22 and the smaller particles are discharged through the discharge port 23. It is preferred to adjust the classification conditions so that the average particle size of the particles classified in the second section will be in the range of about 1–15 microns.

Figure 5:
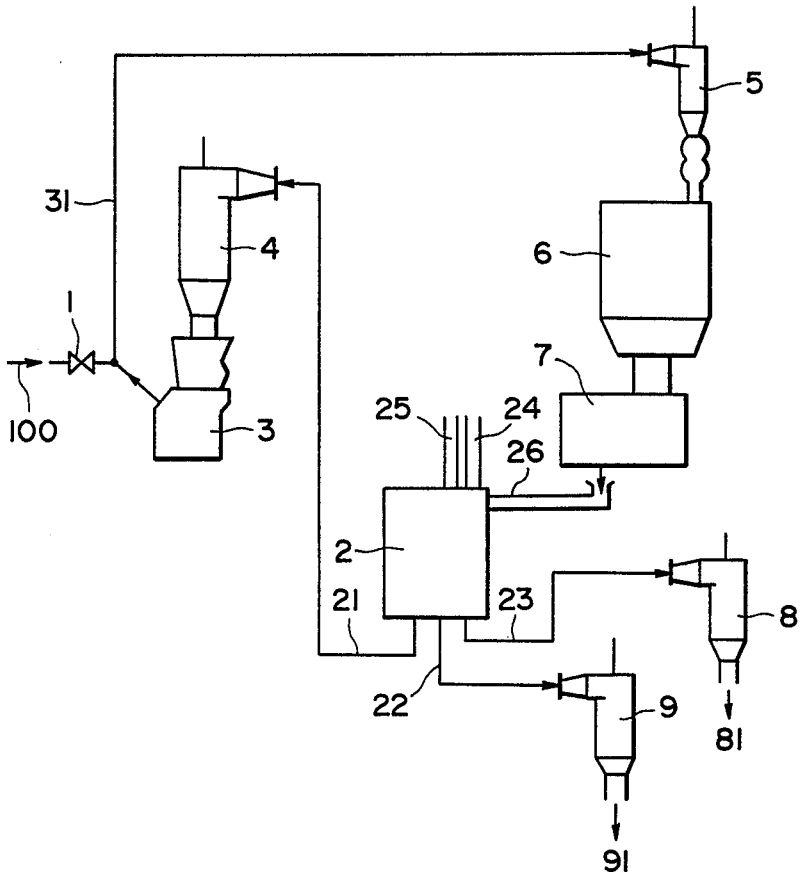
FIGS. 5 and 6 are respectively a schematic view of a classifying system in which the process of the present invention is carried out.

In carrying out the above process, it is usual to use an integral unit system including units interconnected by communication means such as pipes, and a preferred example thereof is shown in FIG. 5. The integral unit system shown in FIG. 5 comprises a three-division classifier 2 (of the type shown in FIG. 2, 3 or 4), a pulverizer 3, a collecting cyclone 4, a collecting cyclone 5, a quantitatively supplying unit 6, a vibration feeder 7, a collecting cyclone 8 and a collecting cyclone 9, which are connected to one another by communication means.

In this system, a so-called pulverized feed material 100 is passed through a feed material supply line 31 provided with a shutter valve 1 to the collecting cyclone 5 and then into the quantitatively supplying unit 6, and then introduced via the vibration feeder 7 through the feed material supply nozzle 26 into the three-division classifier 2. In order to effect the introduction of the feed material, the pulverized feed material may be sucked into the three-division classifier 2 by utilizing the suction force(s) of the collecting cyclones 4, 8 and/or 9. The suction introduction is suitable because the sealing of the unit system is not strictly required as opposed to pressurized introduction. In the suction introduction, thc introduction of the powdered material into the three-division classifier 2 usually at a flow speed of 50 to 200 m/sec which varies depending on the specific gravity and particle size of the particles, is preferred from the viewpoints of classifying accuracy and efficiency. The dimensions of the classifier constituting the classifying zone are usually of (10–50 cm)×(10–50 cm), so that the pulverized material may be classified into three or more groups of particles in an instant of less than 0.1 to 0.01 second. The three-division classifier 2 allows the pulverized material to be classified into the larger (coarse) particles, the medium particles (having a particle size within the defined rang ) and the smaller particles (having a particle size less than the defined range).

Then, the larger particles are passed through the discharge line 21 to the collecting cyclone 4 and then into the pulverizer 3 where it is pulverized. The resulting material is passed, together with the pulverized feed material 100 newly introduced through the feed material supply line 31, into the collecting cyclone 5 and then into the quantitatively supplying unit. Thus, they are subjected to the classifying treatment in the same manner as described above. The medium particles are discharged outside the system through the discharge line 22 and collected in the collecting cyclone 9 for recovery to provide a toner product 91. The smaller particles are discharged outside the system and collected in the collecting cyclone 8, and then recovered as smaller powder 81 out of the defined range. The collecting cyclones 4, 8 and 9 also serve as suction means for the suction introduction of the pulverized feed material into the classifying zone through the nozzle 26.

The pulverizer 3 can be of an impact-type, a jet-type, etc. The impact-type pulverizers include a turbo-mill available from Turbo Kogyo K.K. The pulverizers utilizing a jet include a hypersonic speed jet mill PJM-I available from Nippon Pneumatic Kogyo K.K., and Micron Jet available from Hosokawa Micron K.K. Illustrative of the multi-division classifier used in the process of the present invention are classification means having a Coanda block and utilizing the Coanda effect, e.g., Elbow Jet available from Nitetsu Kogyo K.K. It is preferred to pulverize the coarse powder sent from the first section into a size in the range of from the size of the medium powder to the size of the medium powder plus 20 microns and recycle the pulverized powder from the viewpoint of yield.

Figure 6:
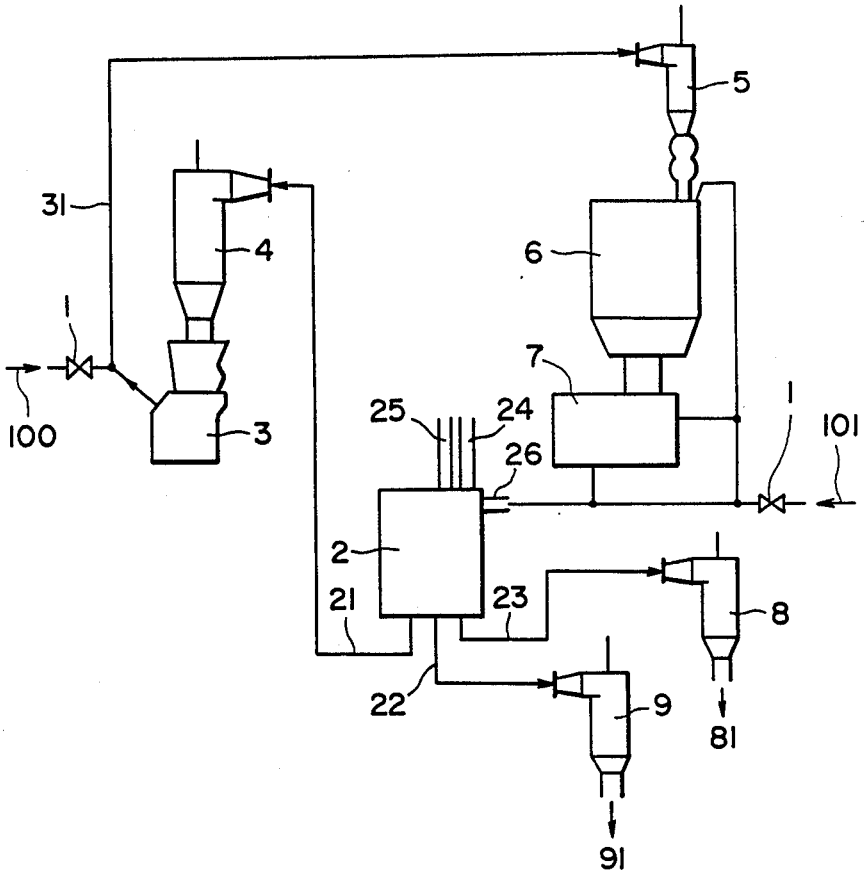

In FIG. 6, there is shown an example of a system in which a pressurized gas 101 is introduced through the shutter valve 1 into the nozzle 26. Compressed air can be used as the pressurized gas 101. In case the pressurized gas 101 is added to introduce the pulverized material through the vibration feeder 7 into the three-division classifier 2, the hermetically gas-sealing in each step and of the connecting means for connecting individual steps, is required.

Under normal operating conditions of the pulverizer and the three-division classifier, it is preferred in respect of yield to adjust the quantity of the coarse powder passing the first section in the range of 0.01 to 100 parts by weight, particularly 0.1 to 20 parts by weight and the quantity of the fine powder passing through the third section in the range of 0.001 to 0.2 part by weight, particularly 0.001 to 0.1 part by weight with respect to 1 part by weight of the medium powder passing through the second section, respectively in a unit period of time.

As discussed above, according to the present invention, the groups of coarse particles and fine particles are concurrently removed by the specified classifying means, and the group of coarse particles is pulverized and recycled. Therefore, even the group of particles having an exquisite distribution of particle sizes within the defined range can be rapidly given with a good efficiency from the powdered material. Further, the process of the present invention can comprises a reduced number of steps, thus making it possible to decrease the cost of product as compared with that in the prior art.

Moreover, in the process of the present invention, there is little residence time in the classifier and hence, the aggregate found in the conventional classifier for removing the coarse powder is not readily produces, and only the coarse particles larger than a certain defined range are passed into the pulverizer. This leads to a less load on the pulverizer, a very good pulverizing efficiency and a reduced tendency to cause over-pulverization. Consequently, the removal of the fine powder can be conducted with a very good efficiency as well, thus affording a satisfactory increase in classification yield. With the prior art classifying system for fractionating the medium and fine powders, the aggregate of fine particles causing fog in developed images is liable to be easily produced, and in the case where the aggregate is produced, it is difficult to remove the aggregate from the medium powder. On the contrary, with the process of the present invention, even if the aggregate is incorporated into the pulverized material, it is broken by the Coanda effect and/or an impact with the high speed movement and removed as fine powder. Further, even though some aggregate is present without disintegration, it can be simultaneously removed into the coarse powder. Thus, the aggregate can be effectively removed.

Usually, a toner for developing electrostatic images is produced by melt kneading starting materials such as a binder resin, e.g., a styrene-based resin, a styrene-acrylic acid ester resin and a styrenemethacrylic acid ester resin, or a polyester resin, a coloring agent (or/and a magnetic material), an anti-offset agent, and a charge control agent, and then subjecting the kneaded mixture to cooling, pulverization, and classification. In this case, because it is difficult to render a melted material, containing the respective starting materials uniformly dispersed in the kneading step, particles unsuitable as toner particles (e.g., those free of a coloring agent or magnetic particles, or those of each feed material alone) are incorporated in the resultant toner. With the prior art pulverizing and classifying processes, the residence time of the particles is longer in the pulverizing and classifying step. For this reason, unsuitable particles were apt to easily aggregate and it was difficult to remove the produced aggregate, resulting in degraded properties of the toner.

In the process of the present invention, the classification is conducted in an instant into three or more fractions after the pulverization and hence, such aggregate is not readily produced. Even if the aggregate is produced, it can be removed as fine powder, thus making it possible to provide a toner product containing uniform component particles and having an accurate distribution of particle sizes.

A toner produced by the process of the present invention has a stable triboelectric charge provided by friction between the toner particles, or between the toner and a toner carrying member such as a sleeve or carrier. Development fog and scattering of toner around the edge of a latent image are extremely reduced, and a high density of image is achieved, leading to a good reproducibility of half tones. Even in the continuous use of a developer including the toner over a long period, an initial performance can be maintained and high quality images can be provided over a long period. Further, even in the use of the toner under environmental conditions of a high temperature and a high humidity, the triboelectric charge of the developer is stable and little vary as compared with that when used under ambient temperature and ambient humidity, because the presence of extremely fine particles and the aggregate thereof are reduced. Therefore, the fog is decreased and image density is increased, enabling the development of images faithful to latent images. Moreover, the resulting toner images have an excellent transfer efficiency to a transfer material such as a paper. Even in the use of the toner under the conditions of a low temperature and a low humidity, a distribution of triboelectric charge is little different from that in the use at ambient temperature and ambient humidity, and because the extremely fine particle component having an extremely large charge has been removed, the toner produced by the process of the present invention has such characteristics that there occur little reduction in density of image and little fog, and roughening and scattering during transfer hardly occur.

In producing a medium powder having a smaller particle size (e.g., an average particle size of 3 to 7 microns), the process of the present invention can be carried out more effectively than the prior art process is.

The present invention will now be described in detail by way of Examples.

EXAMPLE 1

| | |
|---|---|
| Styrene-acrylic acid ester resin (weight ratio of styrene to the acrylic ester 7:3, weight-average molecular weight of about 300,000) | 100 wt. parts |
| Magnetite (particle size: about 0.2 micron) | 60 wt. parts |
| Low molecular weight polyethylene (weight-average molecular weight of about 3,000) | 2 wt. parts |
| Negatively chargeable control agent (Bontrone E81) | 2 wt. parts |

A toner feed material of a mixture having the above prescription was melt-kneaded at 180° C. for about 1.0 hour, and cooled for solidification. The resulting mixture was roughly pulverized into particles of 100 to 1,000 microns in a hammer mill and then pulverized in ACM pulverizer available from Hosokawa Micron K.K. to provide a pulverized material. The specific gravity of the pulverized material was about 1.4. It was fed through the shutter valve to the feed material supply line 31 and introduced at a rate of 1.0 kg/min., utilizing a Coanda effect, via the collecting cyclone 5, the quantitatively supply unit 6 and the vibration feeder 7 into the multi-division classifier shown in FIG. 2. The multi-division classifier used was an Elbow Jet EJ-45-3 type classifier (available from Nitetsu Kogyo K.K.). The pulverized material was introduced into the supply nozzle 26 at a flow speed of about 100 m/sec by a suction force developed from the reduced pressure within the system due to the evacuation of the collecting cyclones 8, 9 and 4 which were in communication with the corresponding discharge ports 21, 22 and 23, respectively. The pulverized material thus introduced was classified in an instant of 0.01 second or less. A medium powder suitable as a toner was collected in a yield of 85% by weight in the collecting cyclone 9 for collecting the classified medium powder, and had a weight-average particle size of 12 microns (containing 0.5% by weight of particles having a particle size of 5.04 microns or less and 0.1% by weight or less, i.e., a substantially negligible amount, of particles having a particle size of 20.2 microns or more). As used herein, the term "yield" refers to a percentage of the amount of the medium powder finally obtained based on the total weight of the powdered material fed. Substantially no aggregate of about 5 microns or larger resulting from the aggregation of extremely fine particles was found by the observation of the obtained medium powder through an electron microscope.

The coarse classified powder was collected in the collecting cyclone 4 and then introduced into the pulverizer 3 (hypersonic speed jet mill PJM-I-10 available from Nippon Pneumatic Kogyo K.K.), where it was pulverized so as to provide a weight-average particle size of about 20 microns. The pulverized powder was ed to the feed material supply line 31 for the classification in the multi-division classifier.

During the normal operation, the coarse powder passing through the first section at a rate of about 8–9 parts by weight and the fine powder passed through the third section at a rate of 0.05 part by weight with respect to 1 part by weight of the medium powder passing through the second section, respectively in a unit period.

The obtained medium powder was used as a toner, and 0.3% by weight of hydrophobic silica was mixed with the toner to prepare a developer. The prepared developer was supplied to a copier NP-270 (available from Canon K.K.) to effect a copying test. The results showed that copied images having no fog and a good developing property for thin lines were provided.

COMPARATIVE EXAMPLE 1

Figure 7:
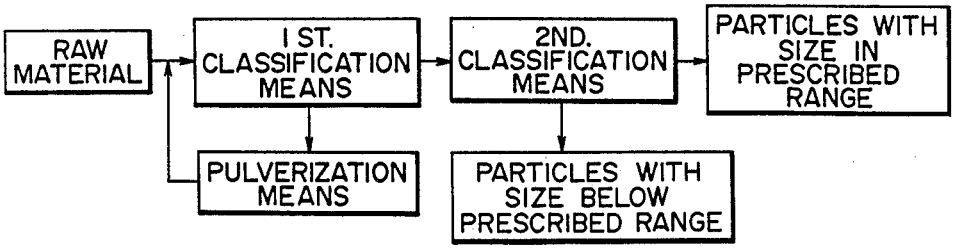
FIG. 7 PRIOR ART
FIG. 7 is a flow chart of a prior art process.

A pulverized material produced in the same manner as in Example 1 was classified in a classifying system constituted as shown in FIG. 7. The pulverized material having a weight-average particle size of 100 microns was introduced into a first classifier (gas stream classifier DS-10UR available from Nippon Pneumatic Kogyo K.K.). The coarse powder classified was introduced into a pulverizer (hypersonic speed jet mill PIM-I-10 available from Nippon Pneumatic Kogyo K.K.), where it was pulverized, and the pulverized powder was then recycled to the first classifier. The medium and fine powder classified in the first classifier were introduced into a second classifier (DS-10UR) and separated from each other. The resultant medium powder had a weight-average particle size of 12 microns and was obtained in a yield of 70% by weight. The observation of the medium powder through an electron microscope showed that aggregate of about 5 microns or more was present in dots, resulting from the aggregation of the extremely fine particles.

The resultant medium powder was used as a toner, and 0.3% by weight of hydrophobic silica was mixed with the toner to prepare a developer. The prepared developer was supplied to a copier NP-270 (available from Canon K.K.) to effect a copying test. The results showed that the duplicated images had increased fog as compared with those obtained in Example 1.

EXAMPLES 2 to 4

Pulverized materials having a weight-average particle size of 50 microns, 30 microns and 20 microns, respectively, were prepared in the same manner as in Example 1. The classification and the pulverization of the pulverized materials were conducted in the same manner as in Example 1. The results are given in the following Table.

TABLE

| Example No. | Particle size* of powdered material (μ) | Particle size* of medium powder (μ) | Yield (wt. %) |
|---|---|---|---|
| 2 | about 50 | about 12 | 85 |
| 3 | about 30 | about 7 | 82 |
| 4 | about 20 | about 5 | 81 |

*Weight-average particle size

COMPARATIVE EXAMPLE 2

A pulverized material having a weight-average particle size of about 20 microns was prepared in the same manner as in Example 1. A medium powder having a weight-average particle size of about 5 microns was produced from the powdered material in the same manner as in Comparative Example 1. As a result, a yield was of 50% by weight which was inferior compared with that in Example 4. The difference in yield between Examples of the present invention and Comparative Examples tended to gradually increase as the particle size of the medium powder become smaller.

What is claimed is:

1. A process for producing toner particles for developing electrostatic latent images, comprising the steps of: introducing colored solid particles containing a binder resin into a multi-division classifying zone divided into at least three sections by partitioning means, so that the particles are distributed by the Coanda effect; collecting (1) a coarse powder consisting primarily of coarse particles in a first divided section, (2) a medium powder consisting primarily of particles having a particle size within a defined range in a second divided section and (3) a fine powder consisting primarily of particles having a particle size smaller than the defined range in a third divided section; discharging each of the coarse powder, the medium powder and the fine powder, respectively, out of the multi-division classifying zone; feeding the classified coarse powder to a pulverizing step; and introducing the pulverized powder into the multi-division classifying zone, wherein said discharged fine powder (3) is not reintroduced into the multi-division classifying zone.

2. A process according to claim 1, wherein said colored solid particles are introduced into the multi-division classifying zone at a velocity of 50–200 m/sec.

3. A process according to claim 1, wherein the coarse powder is pulverized by an impact pulverizer or a jet pulverizer.

4. A process according to claim 1, wherein the coarse powder, the medium powder and the fine powder are respectively collected by a collecting cyclone.

5. A process according to claim 1, wherein said colored solid particles are introduced into the multi-division classifying zone by a suction force of a collecting cyclone.

6. A process according to claim 1, wherein said colored solid particles have a true specific gravity of about 0.5 to 2.

7. A process according to claim 1, wherein said coarse powder is pulverized to an average particle in the range between the average particle size of the medium powder and the average particle size plus 20 microns.

8. A process according to claim 1, wherein the coarse powder is classified into an amount of 100 to 0.01 part by weight with respect to 1 part by weight of the medium powder.

9. A process according to claim 2, wherein said colored solid particles are introduced into the multi-division classifying zone by a suction force of a collecting cyclone.

10. A process according to claim 9, wherein said colored solid particles have a true specific gravity of from about 0.5 to 2.

11. A process according to claim 3, wherein said coarse powder is classified into an amount of 100 to 0.01 part by weight with respect to 1 part by weight of the medium powder.

12. A process according to claim 11, wherein said coarse powder is pulverized to a size within the range between the average particle size of the medium powder and said average particle size plus 20 microns.

13. A process according to claim 12, wherein said medium powder has a weight-average particle size of from about 5 to 12 μm.

* * * * *